United States Patent [19]

Frois et al.

[11] Patent Number: 4,559,731

[45] Date of Patent: Dec. 24, 1985

[54] ILLUMINATED SIGN CONSTRUCTION

[75] Inventors: Mauricio Frois; Daniel W. Leo, both of New York, N.Y.

[73] Assignee: Ledan, Inc., New York, N.Y.

[21] Appl. No.: 642,086

[22] Filed: Aug. 20, 1984

[51] Int. Cl.[4] ..... G09F 13/18

[52] U.S. Cl. ..... 40/546; 40/547; 40/564

[58] Field of Search ..... 40/564, 546, 582, 581, 40/547

[56] References Cited

U.S. PATENT DOCUMENTS 2,651,864 9/1953 Howenstine ..... 40/546

3,491,245 1/1970 Hardesty ..... 40/546

4,034,494 7/1977 Lane ..... 40/564

4,422,719 12/1983 Orcutt ..... 40/547

*Primary Examiner*—Robert Peshock

*Assistant Examiner*—Cary E. Stone

*Attorney, Agent, or Firm*—Charles E. Temko

[57] ABSTRACT

An improved illuminated sign construction utilizing a single source of illumination to back-light a transparency and a surrounding synthetic resinous frame element, the exposed edges of which emit a glow resembling that of a fluorescent tube. The exposed edges may be optionally of rounded configuration to achieve additional brightness.

5 Claims, 2 Drawing Figures

ILLUMINATED SIGN CONSTRUCTION

BACKGROUND OF THE INVENTION

This invention relates generally to the field of illuminated advertising displays commonly used at point of purchase locations to attract the attention of a buyer, and more particularly to an improved form thereof particularly suited for displaying art work in the form of a transparency.

Such transparencies are commonly used in graphic art displays, and usually take the form of a light box containing a source of illumination and a diffusing screen which distributes the light rays emanating therethrough to provide substantially even illumination. While very effective, such displays lack the dramatic attractive effect of neon tubes which are commonly used in commercial establishments as part of an illuminated sign not containing graphic art displays. Although efforts have been made to simulate a neon tube surrounding a graphic art display by providing a continuous area of light transmitting material, and illuminated by the same light source, the effect created is usually disappointing in that the transmitted light lacks intensity and brilliance, so that little enhancement of the graphic art display is obtained. While it is not impossible to provide an actual neon tube for the contemplated purpose, such tubes are expensive to manufacture, and do not eliminate the need for separate illumination of the graphic art display.

SUMMARY OF THE INVENTION

Briefly stated, the invention contemplates the provision of an improved illuminated sign construction in which the above mentioned disadvantages have been substantially eliminated.

The novel light box is constructed to include a single source of illumination, a diffusing screen, and means for supporting a conventional graphic art transparency. Adjacent the inner periphery of the light box is a rectangular light frame of tinted synthetic resinous translucent material having a depth substantially equal to the depth of the light box and having an inner surface lying in the path of light rays emanating from the illumination source. The outer peripheral edges of the frame element are preferably rounded and projects slightly beyond the plane of the transparency to provide a framing effect. Light rays falling upon the inner planar surface of the frame element are refracted to emanate from the curved outer peripheral edges. The relatively small degree of color present in the synthetic resinous material appears with deep intensity at the outer edges with a brilliance approaching that of a neon tube.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
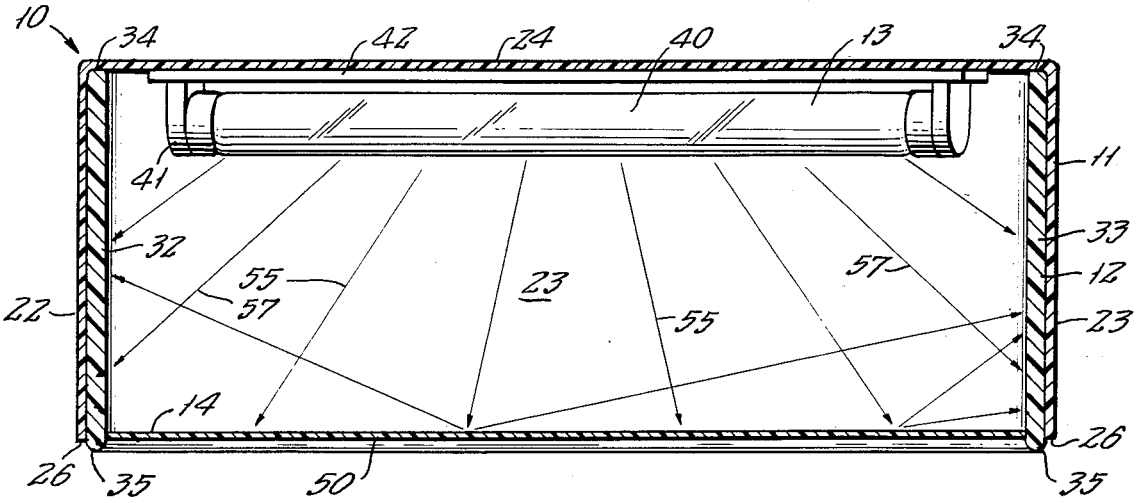
FIG. 1 is a sectional view of an embodiment of the invention as seen from the plane 1—1 in FIG. 2.
Figure 2:
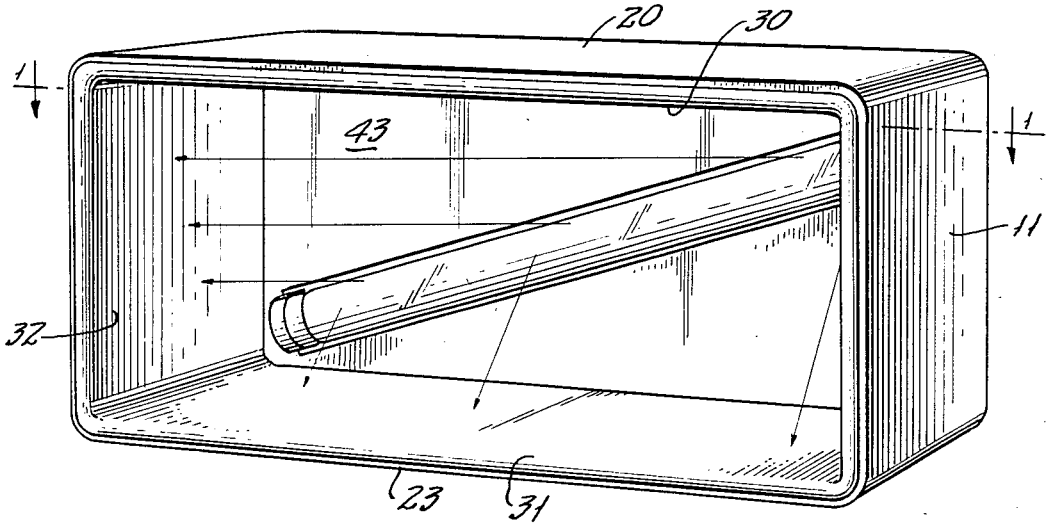
FIG. 2 is a front perspective view thereof.

In accordance with the invention, the device, generally indicated by reference character 10, comprises broadly: an outer housing element 11, an inner frame element 12, illuminating means 13, and transparency support means 14.

The outer housing element 11 is of generally rectangular construction and may be made from any suitable planar opaque material. It includes an upper wall 20, first and second side walls 21 and 22, a lower wall 23 and a rear wall 24. If desired, the entire element 11 may be formed as a unitary molding from suitable synthetic resinous materials.

The inner frame element 12 is most conveniently formed from thermoplastic planar synthetic resinous materials which have been lightly tinted during the manufacture thereof. Acryllic materials are particularly suitable. The dimensions of the inner frame element 12 are such as to fit substantially completely within the outer housing element, and accordingly, it includes an upper wall 30 a lower wall 31, first and second side walls 32 and 33, all of which form a continuous inner edge 34 and a continuous outer edge 35 which may project slightly outwardly of the corresponding continuous edge 26 of the element 11. Although not essential, I have found it preferable to round the edge 35 through an arc of approximately 180°.

The illuminating means 13 preferably includes a fluorescent tube 40 supported by a conventional fixture 41, the base 42 of which is supported upon an inner surface 43 of the rear wall 24. Although the tube 40 is illustrated as being of rectilinear configuration, where desired, a circleline fixture may be substituted. It will be observed that the inner frame element 12 has its inner edge 34 disposed rearwardly of tube 40 for maximum light utilization.

The transparency support means 14 may be a transparent planar member 50 having a light diffusing coating on an inner surface thereof. The outer surface thereof is preferably disposed rearwardly of the edge 35.

Emanating from the tube 40 are a first plurality of light rays 55 which fall directly upon the inner surface of the member 50. A portion of the light is transmitted therethrough to illuminate a conventional transparency (not shown), with the remainder being reflected rearwardly to fall on the inner surface 36 of the element 12. A second set of light rays 57 falls directly upon the same surface, and in each case, these light rays are refracted within the body of the element 12 to exit through the surface forming the edge 35. Although the material from which the element 12 is formed is only lightly tinted, these light rays must pass through a substantial width of the walls 30–33, so that the edge 35, when seen by a viewer appears to be brilliantly colored, and resembles a side surface of a neon tube. This effect is caused by the fact that at least some of the rays falling upon the element 11 pass through the entire width of the walls. I have found that the effect is not obtained where the width of the element 12 is reduced.

It will thus be appreciated that the effect of a neon tube in conjunction with an illuminated transparency has been achieved using only a single source of illumination, and without the necessity of forming an actual neon tube, thus substantially reducing the cost of fabrication of the device.

We wish it to be understood that we do not consider the invention limited to the precise details of structure shown and set forth in this specification, for obvious modifications will occur to those skilled in the art to which the invention pertains.

We claim:

1. Improved illuminated sign construction comprising: an outer housing element of relatively opaque material and defining a forwardly facing opening therein, an inner frame element of planar translucent synthetic resinous material having a degree of color distributed throughout the body thereof, said frame element having a forward peripheral edge disposed within the border of said opening in said housing element and defining a second forwardly facing opening; supporting means disposed within said second opening for supporting a transparency in planar condition, an illuminated means disposed rearwardly of said last mentioned means for illuminating said transparency; said illuminating means also distributing light to inner surfaces of said inner frame element to be refracted to exit from said forward peripheral edge thereof and form an illuminated border surrounding said transparency.

2. Sign construction in accordance with claim 1, further characterized in said supporting means including a transparent planar light diffusing member, said diffusing member reflecting a portion of the light rays falling thereupon upon said inner surface of said inner frame element.

3. Sign construction in accordance with claim 1, further characterized in said inner frame element being form of a lightly dyed acryllic material.

4. Sign construction in accordance with claim 1, further characterized in said inner frame element extending rearwardly of said illumination means.

5. Sign construction in accordance with claim 1, further characterized in said outer housing element having a rear wall, said illumination means being mounted upon an inner surface of said rear wall, said inner frame element having an inner peripheral edge extending rearwardly to said rear wall.

* * * * *